US009772138B2

(12) United States Patent
Hagiwara et al.

(10) Patent No.: US 9,772,138 B2
(45) Date of Patent: Sep. 26, 2017

(54) COOLING BOX

(75) Inventors: Atsushi Hagiwara, Gunma-ken (JP); Ryuichi Tsuruma, Gunma-ken (JP); Yuichi Tamaoki, Gunma-ken (JP)

(73) Assignee: PANASONIC HEALTHCARE HOLDINGS CO., LTD., Tokyo (JP)

( * ) Notice: Subject to any disclaimer, the term of this patent is extended or adjusted under 35 U.S.C. 154(b) by 386 days.

(21) Appl. No.: 13/536,396

(22) Filed: Jun. 28, 2012

(65) Prior Publication Data

US 2013/0000336 A1 Jan. 3, 2013

Related U.S. Application Data

(63) Continuation of application No. PCT/JP2010/073363, filed on Dec. 24, 2010.

(30) Foreign Application Priority Data

Dec. 28, 2009 (JP) ..... 2009-297749

(51) Int. Cl.
*F25B 29/00* (2006.01)
*F25D 31/00* (2006.01)

(52) U.S. Cl.
CPC ..... *F25D 31/005* (2013.01); *F25D 2700/02* (2013.01); *F25D 2700/10* (2013.01); *F25D 2700/12* (2013.01); *F25D 2700/14* (2013.01)

(58) Field of Classification Search
CPC ..... F25D 11/00; F25D 21/002; F25D 21/006; F25D 21/008; F25D 21/02; F25D 21/04;
(Continued)

(56) References Cited

U.S. PATENT DOCUMENTS 3,899,895 A * 8/1975 Blanton ..... F25D 17/065 62/155
5,179,841 A * 1/1993 Phillips et al. ..... 62/81
(Continued)

FOREIGN PATENT DOCUMENTS

JP 61-285361 A 12/1986
JP 62-152171 U 9/1987
(Continued)

OTHER PUBLICATIONS

Kojima, Refrigerator, Jan. 8, 2003, JP2003004355A, Whole Document.*

(Continued)

*Primary Examiner* — Larry Furdge
(74) *Attorney, Agent, or Firm* — McDermott Will & Emery LLP

(57) ABSTRACT

A cooling box to control temperature so that an internal temperature of the cooling box becomes equal to a set temperature, includes: a control device including an temperature sensor to detect an ambient temperature of the box, and adjust a supply amount of warm air into the box after stopping supply of cold air thereinto based on the ambient temperature; and a door sensor to detect whether an opening connected with the interior of the cooling box is in either an open or closed state, when the door sensor detects a change of the opening from an open to closed state. The control device executes control so that the warm-air-supply-amount reaches a first value until a predetermined period has elapsed, and executes control so that the warm-air-supply-amount reaches a second value smaller than the first value after the predetermined period has elapsed.

18 Claims, 4 Drawing Sheets

(58) Field of Classification Search
CPC ..... F25D 21/06; F25D 21/08; F25D 2400/02; F25D 2400/034; F25D 2700/02; F25D 2700/1171; F25D 2700/10; F25D 2700/12; F25D 2700/121; F25B 29/00; F25B 29/003
See application file for complete search history.

(56) References Cited

U.S. PATENT DOCUMENTS

| | | | | |
|---|---|---|---|---|
| 5,231,844 | A * | 8/1993 | Park | 62/80 |
| 5,842,355 | A * | 12/1998 | Kalis et al. | 62/234 |
| 5,850,969 | A * | 12/1998 | Hong et al. | 236/49.3 |
| 6,058,724 | A * | 5/2000 | Park | 62/156 |
| 6,606,870 | B2 * | 8/2003 | Holmes et al. | 62/155 |
| 6,694,754 | B1 * | 2/2004 | Schenk et al. | 62/156 |
| 2001/0047657 | A1 * | 12/2001 | Cho | F25D 11/022 62/156 |
| 2005/0217286 | A1 * | 10/2005 | Jeong | F25D 21/08 62/151 |
| 2007/0033962 | A1 * | 2/2007 | Kang | F25B 5/04 62/441 |
| 2009/0173093 | A1 * | 7/2009 | Sueda | F25D 17/062 62/157 |

FOREIGN PATENT DOCUMENTS

| | | | | |
|---|---|---|---|---|
| JP | 63-318461 | A | | 12/1988 |
| JP | 02-066612 | A | | 3/1990 |
| JP | 04-136671 | A | | 5/1992 |
| JP | 06-159890 | A | | 6/1994 |
| JP | 11-173728 | A | | 7/1999 |
| JP | 2003004355 | A | * | 1/2003 |
| JP | 2003166776 | A | * | 6/2003 |
| JP | 2007-003145 | A | | 1/2007 |

OTHER PUBLICATIONS

Akihiro et al., Control Device for Refrigerator, Jun. 13, 2003, JP2003166776A, Whole Document.*
Japanese Office Action issued in Japanese Application No. 2009-297749 dated Feb. 18, 2014.
Supplementary European Search Report issued in corresponding European Patent Application No. 10840954.1 dated Aug. 3, 2016.
International Search Report issued in PCT/JP2010/073363 dated Mar. 8, 2011, and an English translation thereof, 4 pages.
Patent Abstracts of Japan, Publication No. 04-136671, Publication Date: May 11, 1992, 1 page.

* cited by examiner

COOLING BOX

CROSS-REFERENCE TO RELATED APPLICATION

This application claims the benefit of priority to Japanese Patent Application No. 2009-297749, filed Dec. 28, 2009, of which full contents are incorporated herein by reference.

BACKGROUND OF THE INVENTION

Field of the Invention

The present invention relates to a cooling box.

Description of the Related Art

A cooling box includes a refrigeration device, and is configured to cool an item to be refrigerated at a fixed temperature through an evaporator configuring the refrigeration device disposed in a thermally insulated casing by intermittently operating the refrigeration device.

When an evaporator is disposed in the thermally insulated casing as such, frost is likely to be attached to the surface of the evaporator. Since this frost disturbs heat exchange between air in the thermally insulated casing and refrigerant in the evaporator, thereby reducing the temperature of the refrigerant, resulting in that the refrigeration device becomes unable to perform efficient cooling in the thermally insulated casing.

Thus, a cooling box is disclosed that is provided with a heater configured to prevent attachment of frost onto the surface of the evaporator disposed in the thermally insulated casing and to melt frost attached to the surface (see Japanese Patent Application Laid-Open Publication No. 6-159890, for example). For example, such a cycle is continuously repeated that the heater is operated while the refrigeration device configured to intermittently operate stops operating, thereby preventing attachment of frost onto the surface of the evaporator or removing frost attached to the surface while cooling the item to be refrigerated at a fixed temperature.

However, a method of continuously repeating the operation of the heater and the refrigeration device as described above result in the problem that energy efficiency is poor due to constant supply of the power to the electrical heater, the compressor, or the like for example.

Further, in the case where the operations of the heater and the refrigeration device are repeated uniformly, when the ambient temperature of the thermally insulated casing changes, the temperature inside the casing is affected by such change, resulting in the problem that it is difficult to maintain the temperature inside the thermally insulated casing at a fixed value. In this type of the cooling box, items to be refrigerated which should not be frozen, particularly, blood, vaccines, and medical products, cannot be preserved.

SUMMARY OF THE INVENTION

A cooling box according to an aspect of the present invention, which is configured to perform temperature control by supplying cold air into an interior thereof when an internal temperature thereof is higher than a set temperature so that the internal temperature of the cooling box to store an item to be refrigerated becomes equal to the predetermined set temperature, and supplying warm air into the interior thereof when the internal temperature thereof is lower than the set temperature so that the internal temperature of the cooling box reaches the set temperature, the cooling box includes: a control device including an ambient temperature sensor configured to detect an ambient temperature of the cooling box, the control device configured to adjust a supply amount of warm air into the cooling box after stopping supply of cold air into the cooling box based on the temperature detected by the ambient temperature sensor; and a thermally insulating door sensor configured to detect whether an opening connected with the interior of the cooling box is in either an open or a closed state, when the thermally insulating door detects a change of the opening from an open state to a closed state, the control device executing control so that the supply amount of warm air becomes equal to a first value until a predetermined period has elapsed, and executing control so that the supply amount of warm air becomes equal to a second value smaller than the first value after the predetermined period has elapsed.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

Configuration Example of Cooling Box

Figure 1:
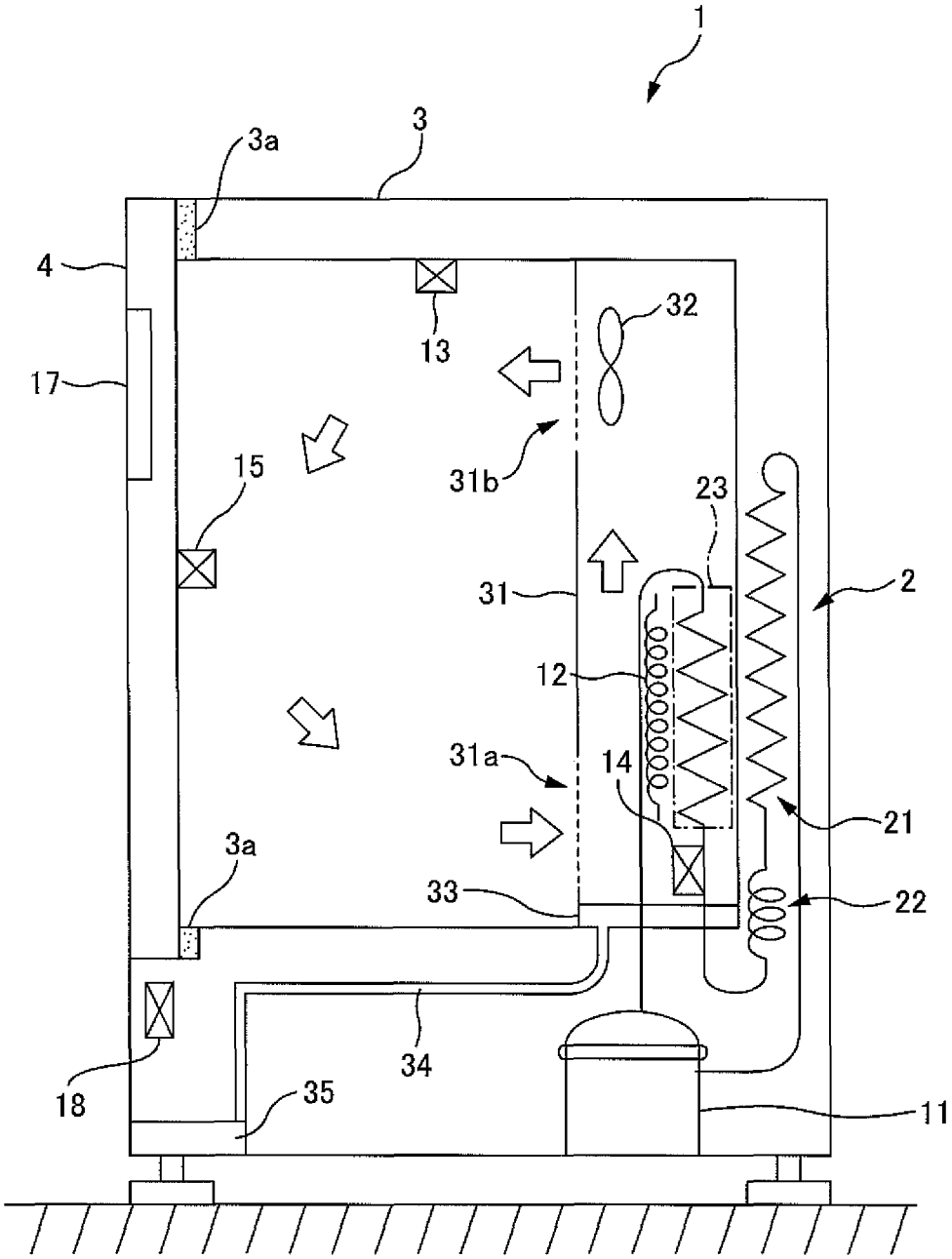
FIG. 1 is a partial sectional view illustrating an example of an overall configuration of a cooling box according to an embodiment of the present invention.
Figure 2:
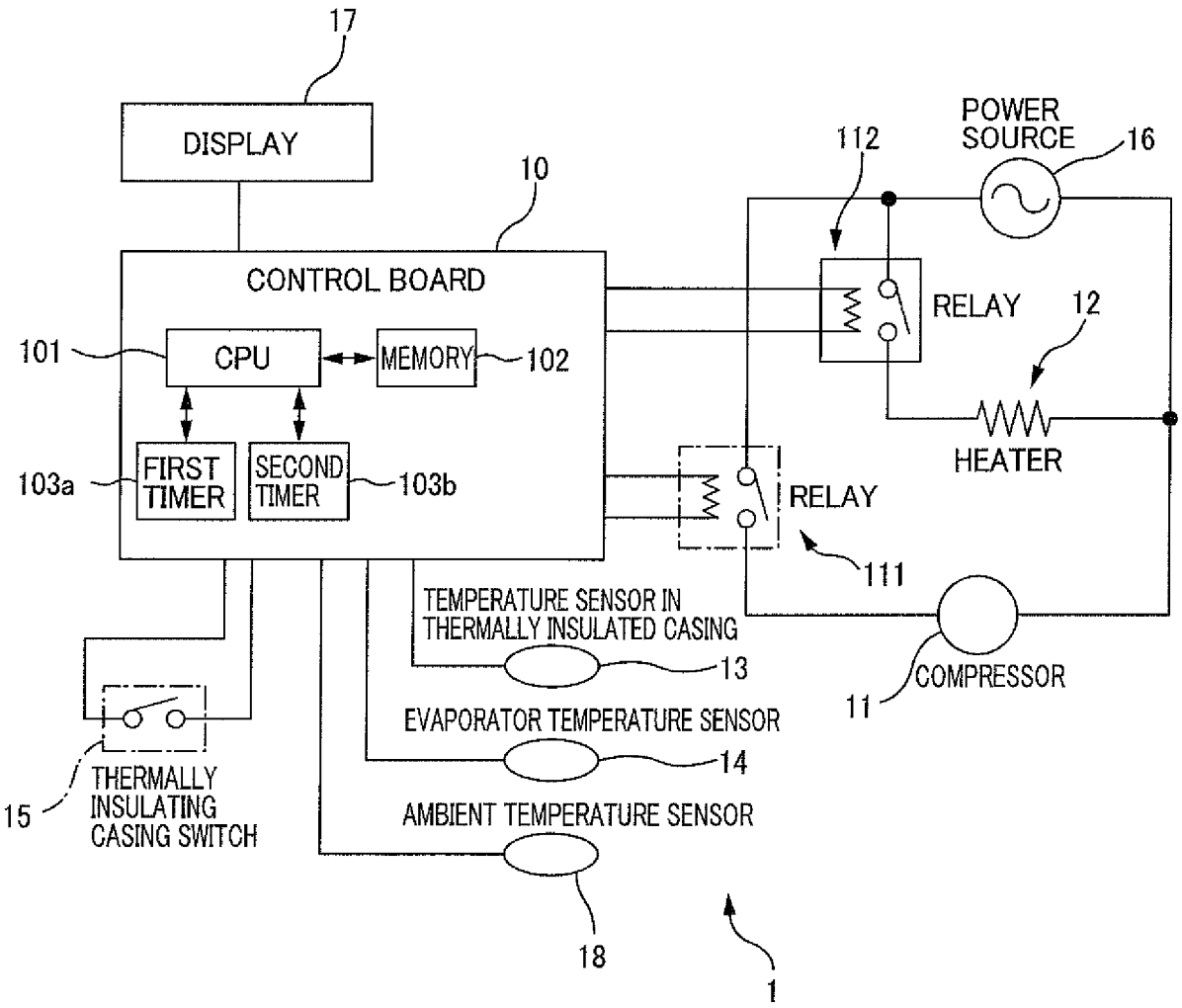
FIG. 2 is a block diagram illustrating an example of a configuration in which control of a cooling box is performed according to an embodiment of the present invention.

With reference to FIG. 1 and FIG. 2, a description will be given of a configuration example of a cooling box 1 according to an embodiment of the present invention. FIG. 1 is a partial sectional view illustrating an example of the overall configuration of a cooling box 1. FIG. 2 is a block diagram illustrating an example of a configuration in which control of the cooling box 1 is performed.

As illustrated in an embodiment in FIG. 1 and FIG. 2, the cooling box 1 includes a refrigeration device 2, a heater (heating device) 12, a thermally insulated casing 3, a thermally insulating door 4, an ambient temperature sensor 18, and a control board (control device, detecting device) 10.

The refrigeration device 2, as illustrated in an embodiment in FIG. 1, is configured with a compressor 11, a condenser 21, capillary tube (pressure reducing device) 22, and an evaporator 23 connected in a loop by refrigerant piping. In order to obtain the refrigerant action, the refrigeration device 2 is configured to condense the refrigerant discharged from the compressor 11 in the condenser 21, and thereafter, such condensed refrigerant is reduced in pressure in the capillary tube 22, to be evaporated in the evaporator 23. In particular, the evaporator 23 according to an embodiment of the present embodiment is configured with an evaporation tube in a meander form, for example, and is disposed on the rear surface inside the thermally insulated casing 3 (on the right side of the page in FIG. 1). In an embodiment illustrated in FIG. 1, an evaporator temperature sensor 14, such as a thermistor configured to detect the temperature of the evaporator 23, is mounted on the surface of the refrigerant piping which is connected to the inlet side of the refrigerant evaporation tube configuring the evaporator 23.

The heater 12, as illustrated in an embodiment in FIG. 1, is a heating device such as an electric heater or the like disposed along the tube in order to prevent frost from being attached to the surface of the evaporation tube configuring the evaporator 23 or to melt frost attached to the surface thereof. As will be described later, the heater 12 according to an embodiment of the present invention is energized to be operated in such a manner as to alternate with the refrigeration device 2.

The thermally insulated casing 3, as illustrated in FIG. 1, has an opening on the front surface side (on the left side of the page in FIG. 1) for loading and unloading an item to be refrigerated (item to be refrigerated is blood, a vaccine, a medical product, or the like, for example), and the evaporator 23 is disposed together with the heater 12 through a partitioning panel 31 on the rear surface side in an interior thereof (on the right side of the page in FIG. 1). That is to say, in an embodiment illustrated in FIG. 1, in the thermally insulated casing 3, a space (accommodating chamber) is formed to accommodate the item to be refrigerated between the thermally insulating door 4 and the partitioning panel 31, and a space (cooling chamber) is formed to cool the air in the accommodating chamber between the partitioning panel 31 and the inner wall on the rear surface side. More specifically, an intake 31*a* is formed on the lower side of the partitioning panel 31 (on the lower side of the page in FIG. 1), an outlet 31*b* is formed on the upper side of the partitioning panel (on the upper side of the page in FIG. 1), the evaporator 23 is disposed together with the heater 12 on the rear surface side of the intake 31*a*, and a fan 32 is disposed on the rear surface side of the outlet 31*b*. When the fan 32 operates, the air in the accommodating chamber passes through the intake 31*a* and is cooled by the evaporator 23 in the cooling chamber, and then passes through the outlet 31*b* to return to the accommodating chamber (see outline arrows of FIG. 1). In an embodiment illustrated in FIG. 1, on the bottom part of the cooling chamber, a tray 33 is formed for receiving water produced by the frost, attached to the surface of the evaporator 23, being melted. The water contained in the tray 33 is guided through a hose 34 in the machine compartment on the lower side of the thermally insulated casing 3 to an evaporating dish 35, and then is evaporated from an evaporating dish 35 into the atmosphere. Furthermore, as illustrated in an embodiment in FIG. 1, the compressor 11, etc., is disposed in the machine compartment on the lower side of the thermally insulated casing 3, and a condenser 21 and capillary tube 22, etc., are disposed on the rear surface side of the thermally insulated casing 3. Further, in an embodiment illustrated in FIG. 1, a thermally insulated casing internal temperature sensor 13, such as a thermistor or the like, configured to detect the temperature in the thermally insulated casing 3 is disposed on an upper portion in the thermally insulated casing 3.

A thermally insulating door 4 is a door for opening or closing the opening described above in the thermally insulated casing 3. In particular, when the opening of the thermally insulating door 4 is closed, as illustrated in an embodiment in FIG. 1, a packing 3*a* on the periphery of the opening is brought into intimate contact with the rear surface of the thermally insulating door 4, thereby isolating the interior of the thermally insulated casing 3 from the atmosphere. As illustrated in an embodiment in FIG. 1, for example, a display 17 for displaying a temperature, etc., inside the thermally insulated casing 3 is provided on the front surface of the thermally insulating door 4*a*. Further, as illustrated in an embodiment in FIG. 1, a thermally insulating door switch (thermally insulating door sensor) 15, which is configured to be in an ON state when the opening is in an open state and be in an OFF state when it is in a closed state, for example, is provided in either of the opening in the thermally insulated casing 3 and the thermally insulating door 4.

The ambient temperature sensor 18 is a thermistor or the like for detecting the ambient atmospheric temperature with respect to the thermally insulated casing 3. The ambient temperature sensor 18, as illustrated in an embodiment in FIG. 1, is disposed on the rear surface side of a duct (not illustrated) provided on the front surface of the machine compartment on the lower side of the thermally insulated casing 3, and is in constant contact with the atmosphere taken into the machine compartment through the duct by the operation of a fan (not illustrated) for cooling the compressor 11.

The control board 10, as illustrated in an embodiment in FIG. 2, is a control device such as a microcomputer including a CPU 101, a memory 102, a first timer 103*a*, a second timer 103*b*, and the like.

The CPU 101, in an embodiment illustrated in FIG. 2, integrally controls the memory 102, the first timer 103*a*, the second timer 103*b*, a relay 111 configured to cause the compressor 11 to operate or stop operating, a relay 112 configured to start or stop operation of the heater 12, the thermally insulated casing internal temperature sensor 13, the evaporator temperature sensor 14, the ambient temperature sensor 18, the thermally insulating door switch 15 and the display 17. The relay 111 is configured to connect in series between the compressor 11 and the power source 16 in the ON state, and disconnect such connection in series in the OFF state. The relay 112 is configured to connect in series between the heater 12 and the power source 16 in the ON state, and disconnect such connection in series in the OFF state. As will be described later, for example, the CPU 101 causes the compressor 11 to operate or stop operating in response to the detection result of the thermally insulated casing internal temperature sensor 13 so that the temperature inside the thermally insulated casing 3 is maintained in an allowable temperature range (between the minimum allowable temperature and the maximum allowable temperature as will be described later) based on a program stored in the memory 102, as well as executes such processing, etc., as to cause the heater 12 to operate or stop operating based on the ratio of the operating time (operating period) of the heater 12 relative to the operation stoppage time (operation stoppage period) of the compressor 11 set in response to the detection result of the ambient temperature sensor 18. However, it is not limited to such a "ratio", and in short, the CPU 101 may execute such processing as to adjust the amount supply of warm air from the heater 12 into the thermally insulated casing 3 after stopping supply of cold air from the evaporator 23 into the thermally insulated casing 3 (into the interior thereof) in response to the temperature detected by the ambient temperature sensor 18. The supply amount of warm air is adjusted by changing the period of warm air supply, for example.

The memory 102 stores programs for determining the processing sequence of the CPU 101, as will be described below, and various types of data or the like used when processing is performed by the CPU 102.

The first timer 103*a* measures the elapsed time or the like after operation of the heater 12 has been stopped as will be described below, for example. The second timer 103*b* measures the elapsed time or the like after the thermally insulating door 4 has been opened or closed as will be described below, for example.

In an embodiment of the present embodiment, the control board 10 acts also as a detecting device configured to detect an abnormality in the ambient temperature sensor 18, the evaporator temperature sensor 14, the thermally insulating door switch 15, and the like, for example. The actual determination method will be described hereafter.

In the case of the ambient temperature sensor 18 and the evaporator temperature sensor 14, the CPU 101 determines a "disconnection" when the detected resistance value of the thermistor exceeds a preset predetermined value, and determines a "short circuit (caused by entry of water or the like, for example)" when the detected resistance value of the thermistor is substantially 0. That is to say, in either case, the CPU 101 determines that the ambient temperature sensor 18 and the evaporator temperature sensor 14 are abnormal.

In the case of the thermally insulating door switch 15, the CPU 101 determines that the thermally insulating door switch 15 is "abnormal", when the temperature detected by the thermally insulated casing internal temperature sensor 13 is lower than or equal to a preset predetermined temperature even though the time period measured by the second timer 103*b*, during which the thermally insulating door switch 15 is in the ON state, exceeds the preset predetermined period, for example. The predetermined time period and the predetermined temperature are respectively set at such values that the temperature inside the thermally insulated casing 3 exceeds the predetermined temperature without fail if the opening of the thermally insulated casing 3 continues to be in an open state by the thermally insulating door 4 during a time period exceeding the predetermined time period, for example.

===Example of Operation of Cooling Box===

Figure 3:
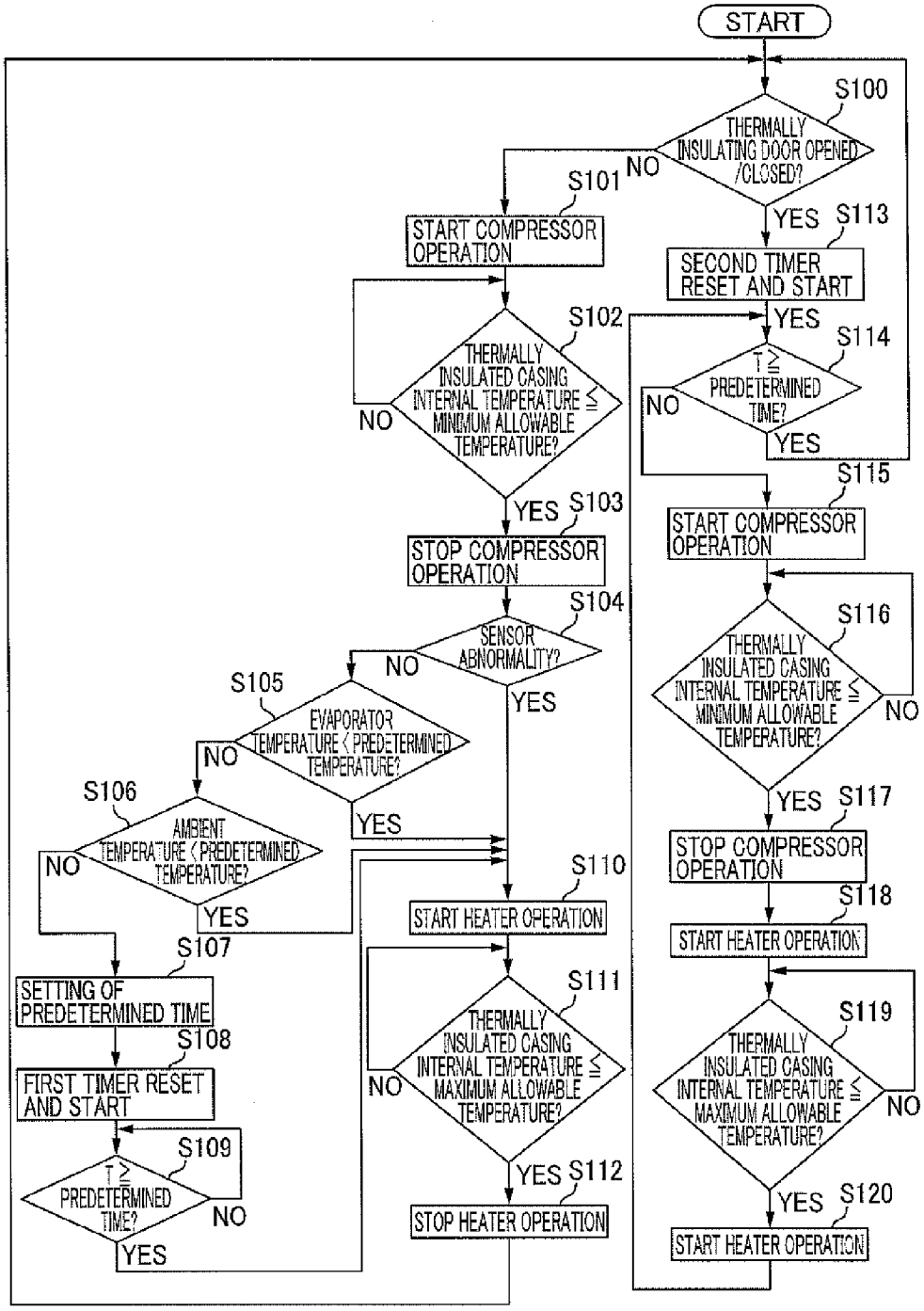
FIG. 3 is a block diagram illustrating an example of a processing sequence for a CPU according to an embodiment of the present invention.
Figure 4:
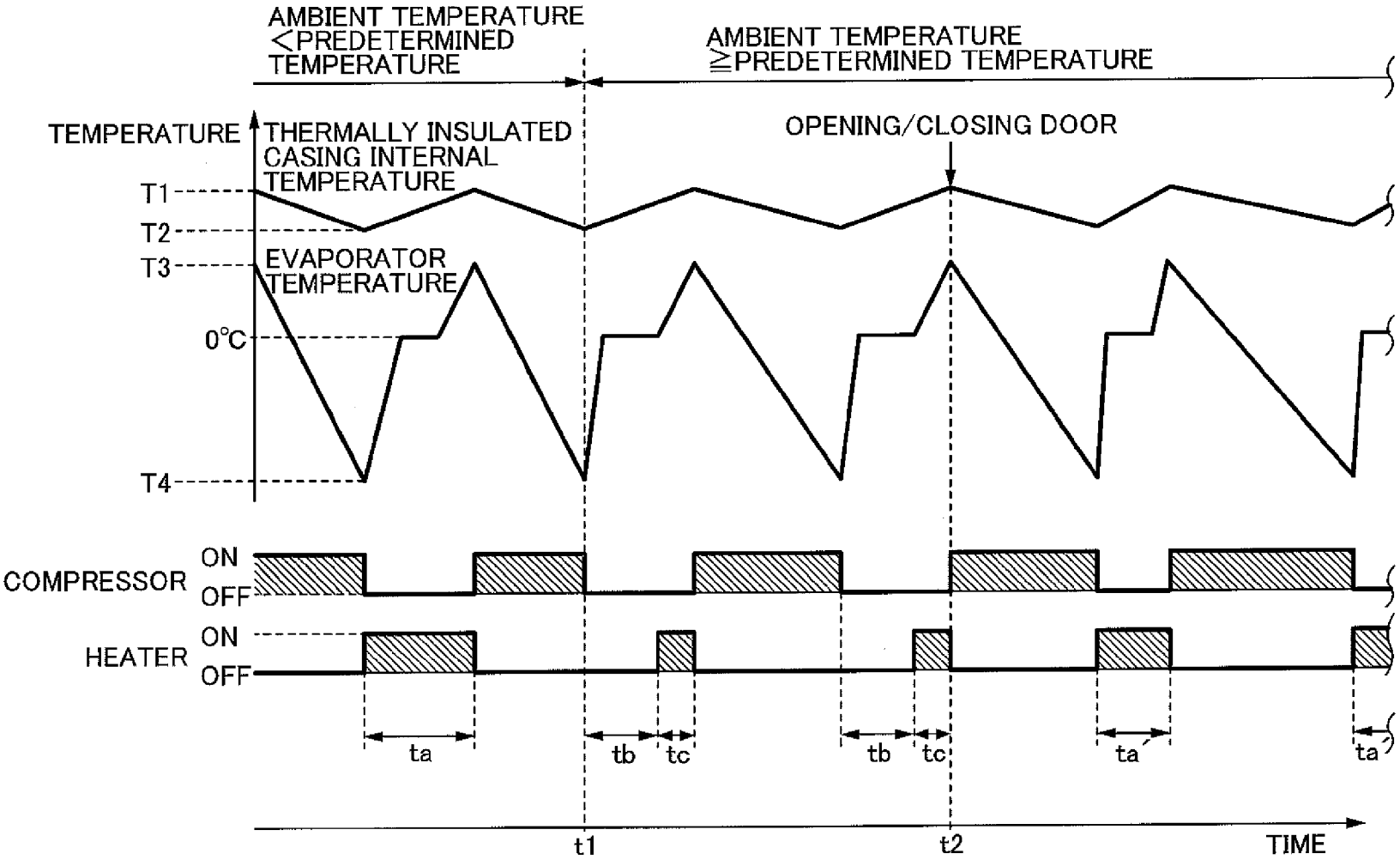
FIG. 4 is a diagram illustrating an example of time change in an operational state of a heater, an operational state of a compressor, a temperature of an evaporator, and a temperature inside a thermally insulated casing according to an embodiment of the present invention.

An operation example of the cooling box 1 including the above described configuration will be described with reference to FIG. 3 and FIG. 4. FIG. 3 is a block diagram illustrating an example of a processing sequence for the CPU 101 of the control board 10. FIG. 4 is a diagram illustrating an example of time variation in the temperature in the thermally insulated casing 3, the temperature of the evaporator 23, the operating state of the compressor 11, and the operating state of the heater 12.

<<<Processing Sequence of CPU>>>

As illustrated in an embodiment in FIG. 3, the CPU 101 determines whether or not the thermally insulating door switch 15 has changed from the OFF state (corresponding to the closed state of the opening of the thermally insulating casing 3, for example) through the ON state (corresponding to the open state of the opening of the thermally insulating casing 3, for example), and again to the OFF state (S100).

In an embodiment of the present invention, for example, every time the thermally insulating door switch 15 changes in state (from the ON state to the OFF state, or from the OFF state to the ON state), the CPU 101 stores, in the memory 102, the levels of a series of signals received from the thermally insulating door switch 15 associated with such changes, corresponding to the receipt time measured by the second timer 103*b*. Then, the CPU 101, in step S100, reads that information from the memory 102, and based on such read information, determines whether or not the thermally insulating door 4 has been opened or closed on step S100 or immediately after the step S100.

<1. When Thermally Insulating Door has not been Opened or Closed>

When it is determined that the thermally insulating door 4 has not been opened or closed, (S100: NO), the CPU 101 drives the relay 111 to start operating the compressor 11 (S101). In this manner, the refrigeration device 2 starts operating.

The CPU 101 determines whether or not the temperature detected by the thermally insulating casing internal temperature sensor 13 has reached the predetermined minimum allowable temperature in the thermally insulating casing 3 (S102). When it is determined that the temperature in the thermally insulating casing 3 has not reached the predetermined minimum allowable temperature (S102: NO), the CPU 101 executes the processing in step S102 again. When it is determined that the temperature in the thermally insulating casing 3 has reached the predetermined minimum allowable temperature (S102: YES), the CPU 101 drives the relay 111 to stop the operation of the compressor 11 (S103). In this manner, the operation of the refrigeration device 2 is stopped. The CPU 101 determines whether or not there is an abnormality in the ambient temperature sensor 18, the evaporator temperature sensor 14, the thermally insulating door switch 15, etc. (hereinafter collectively referred to as "sensors") (S104).

<1-1. When No Abnormality in Sensors>

When it is determined that there is no abnormality in the sensors (S104: NO), the CPU 101 determines whether or not the temperature detected by the evaporator temperature sensor 14 is lower than the predetermined temperature (S105). The predetermined temperature of the evaporator 23 according to an embodiment of the present invention is the minimum allowable temperature of the evaporator 23 at which the interior of the thermally insulated casing 3 does not become lower than the minimum allowable temperature.

<1-1-1. When Temperature of Evaporator Higher than or Equal to Predetermined Temperature>

When it is determined that the temperature detected by the evaporator temperature sensor 14 is not lower than the preset predetermined temperature (i.e., equal to or higher than the preset predetermined temperature) (S105: NO), the CPU 101 determines whether or not the temperature detected by the ambient temperature sensor 18 (hereinafter referred to as "ambient temperature") is lower than the preset predetermined temperature (S106). The predetermined temperature with respect to the ambient temperature according to an embodiment of the present invention is a temperature that enables reduction in the operating period of the heater 12 while maintaining the temperature in the thermally insulating casing 3 within an allowable temperature range (between the minimum allowable temperature and the maximum allowable temperature), for example. As used herein, more specifically, the reduction in the operating time of the heater 12 indicates that the ratio (second ratio) of the operating time (operating period) of the heater 12 relative to the operation stoppage time (operation stoppage period) of the compressor 11 at an ambient temperature that is higher than or equal to the predetermined temperature is made smaller than the ratio (first ratio) of the operating time (operating period) of the heater 12 relative to the operation stoppage time (operation stoppage period) of the compressor 11 at an ambient temperature that is lower than the predetermined temperature. However, it is not limited to such "ratio". The first ratio corresponds to a first value indicating the amount of supply of warm air from the heater 12 into the thermally insulating casing 3 after stopping of supply of cold air from the evaporator 23 into the thermally insulating casing 3 (into the interior) when the ambient temperature is lower than the predetermined temperature. The second ratio corresponds to a second value (smaller than the first value) indicating the amount of supply of warm air from the heater 12 into the thermally insulating casing 3 after stopping of supply of cold air into the thermally insulating casing 3 from the evaporator 23 when the ambient temperature is higher than or equal to the predetermined temperature. The supply amount of warm air is adjusted by changing the time period during which warm air is supplied, for example.

<1-1-1-1. When Ambient Temperature Higher than or Equal to Predetermined Temperature>

When it is determined that the ambient temperature is not lower than the preset predetermined temperature (i.e., higher than or equal to the predetermined temperature) (S106: NO), the CPU 101 reads, from the memory 102, the ratio (second ratio) of the operating time of the heat 12 relative to the operation stoppage time of the compressor 11, and based on the ratio, set the setting time for standby without operation of the heater 12, for example (S107). In an embodiment of the present invention, the above described first ratio when the ambient temperature is lower than the predetermined temperature, the above described second ratio when the ambient temperature is higher than or equal to the predetermined temperature, and the operation stoppage time of the compressor 11 (however, this is the scheduled time) and the like are predetermined on the basis of experimentation or the like. In particular, in to the case of the second ratio lower than 1, as illustrated in an embodiment in FIG. 4, the operating time of the heater 12 (time tc) is set so as to be followed by the operating time of the compressor 11 immediately thereafter. Thus, in step S107 according to an embodiment of the present invention, the CPU 101 reads from the memory 102 information indicating the operation stoppage time of the compressor 11 and/or the second ratio associated with the information indicative of the ambient temperature that is higher than or equal to the predetermined temperature, etc.; and, based on such read information, set the predetermined time from a time when the compressor 11 stops operating to a time when the heater 12 starts operating (time tb as illustrated in an embodiment in FIG. 4). However, it is not limited thereto, and information indicative of a preset predetermined time may be stored in the memory 102. The operating time of the heater 12 is not limited to that it is set so as to be followed by the operating time of the compressor 11 immediately thereafter, but the heater 12 may start operating immediately after the compressor 11 has stopped operating, for example. That is to say, the supply of warm air from the heater 12 into the thermally insulated casing 2 (into the interior thereof) may be started continuously from the stopping of the supply of cold air from the evaporator 23 into the thermally insulating casing 2.

The CPU 101 starts to measure time after resetting the first timer 103*a* (S108), and it is determined whether or not the time t measured by the first timer 103*a* has reached a predetermined time that has been set in the step S107 (S109). When it is determined that the time t measured by the first timer 103*a* has not reached a predetermined time that has been set in the step S107 (S109: NO), the CPU 101 executes the processing in the step S109 again. During this period, both the compressor 11 and the heater 12 stop operating. When it is determined that the time t measured by the first timer 103*a* has reached the predetermined time (S109: YES), the CPU 101 drives the relay 112 to energize the heater 12 (S110) in this manner, the heater 12 starts operating.

The CPU 101 determines whether or not the temperature detected by the thermally insulating casing internal temperature sensor 13 has reached the predetermined maximum allowable temperature in the thermally insulating casing 3 (S111). Hereinafter, the set temperature positioned between the minimum allowable temperature and the maximum allowable temperature is assumed to be a target temperature in an embodiment of the present invention. As an example, the target temperature is the average temperature of the minimum allowable temperature and the maximum allowable temperature.

When it is determined that the temperature in the thermally insulated casing 3 has not reached the maximum allowable temperature (S111: NO), the CPU 101 executes the processing in the step S111 again. When it is determined that the temperature in the thermally insulated casing 3 has reached the maximum allowable temperature (S111: YES), the CPU 101 drives the relay 112 to stop energizing the heater 12 (S112). In this manner, the heater 12 stops operating. Hereinafter, the CPU 101 executes the processing in the step S100 again.

<1-1-1-2 When Ambient Temperature Lower than Predetermined Temperature>

As illustrated in an embodiment in FIG. 3, it is determined that when the ambient temperature is lower than the preset predetermined temperature (S106: YES), the CPU 101 executes the processing in the above described steps S110, S111, and S112. In an embodiment of the present invention, the first ratio associated with the above described ambient temperature when the ambient temperature is lower than the predetermined temperature is set at a value of 1. Thus, the processing after step S106: YES is equivalent to the processing in the steps S110, S111, and S112 in which power is continuously supplied to the heater 12 during the operation stoppage time of the compressor 11.

According to the above description, as illustrated in an embodiment in FIG. 4, in order that the temperature inside the thermally insulated casing 3 reaches the target temperature (e.g., (T1+T2)/2), the ratio of the operating time of the heater 12 relative to the operation stoppage time of the compressor 11 may be changed from "ta/tb" (=1) to "tc/(tb+tc)" (<1) in response to the ambient temperature. Generally, the higher the ambient temperature becomes, the less the amount of heat of the heater 12 is required for the temperature inside the thermally insulated casing 3 to reach the target temperature. Thus, energy saving performance is improved by providing a time tb (predetermined time) for standby without operation of the heater 12 during the operation stoppage time of the compressor 11 as illustrated in an embodiment of the present invention. Whereas, a time tb is provided to suppress excessive heating by the heater 12, thereby facilitating maintenance of the temperature inside the thermally insulated casing 3 at the target temperature. That is to say, the temperature inside the thermally insulated casing 3 can be maintained at a fixed value while energy efficiency being improved.

As illustrated in an embodiment in FIG. 4, the operating time tc of the heater 12 may be controlled so as to be followed by the operating time of the compressor 11 immediately thereafter. The timing of the time tb (predetermined time) for standby without operation of the heater 12 is set before the timing of the time tc in which the heater 12 operates, thereby enabling operation of the heater 12 during a time tc, in which the temperature of the evaporator 23 is higher than 0° C., without operation of the heater 12 in the time tb, in which the temperature of the evaporator 23 is lower than or equal to 0° C., for example. That is to say, operation of the heater 12 is started at a time at which the temperature of the evaporator 23 has become higher, thereby being able to reduce the power supplied to the heater 12.

As illustrated in an embodiment in FIG. 4, when the ambient temperature is lower than the predetermined temperature, the ratio of the operating time of the heater 12 relative to the operation stoppage time of the compressor 11 is expressed as "ta/ta" (first ratio), and when the ambient temperature is higher than or equal to the predetermined temperature, it is expressed as "tc/(tb+tc)" (second ratio) which is smaller than the first ratio. When the predetermined temperature is set, for example, at such a temperature that the target temperature inside the thermally insulating casing 3 can be maintained and the second ratio is smaller as compared with the first ratio, thereby being able to maintain the target temperature further effectively as well as improve energy efficiency.

Although the first ratio as described above is assumed to be a value of 1, it is not limited thereto, and as long as the ratio is at least larger than the second ratio, it may be set at a value smaller than 1, for example.

<1-1-2 When Temperature of Evaporator Lower than Predetermined Temperature>

As illustrated in an embodiment in FIG. 3, when it is determined that the temperature detected by the evaporator temperature sensor 14 is lower than the preset predetermined temperature (S105: YES), the CPU 101 executes the processing in the above described steps S110, S111, and S112. In an embodiment of the present invention, the ratio of the operating time of the heater 12 relative to the operation stoppage time of the compressor 11 when the temperature of the evaporator 23 is lower than the predetermined temperature (second ratio) is set to be greater than the ratio of the operating time of the heater 12 relative to the operation stoppage time of the compressor 11 when the temperature of the evaporator 23 is higher than or equal to the predetermined temperature (first ratio). In particular, the second ratio associated with the temperature of the evaporator 23 according to an embodiment of the present invention is assumed to be set at a value of 1 which is equal to the first ratio associated with the above described ambient temperature. Thus, the processing after step S105: YES is equivalent to the processing in the steps S110, S111, and S112 where power is continuously supplied to the heater 12 during the operation stoppage time of the compressor 11. Further, it is assume that the first ratio associated with the temperature of the evaporator 23 according to an embodiment of the present embodiment is set to be equal to the above described second ratio associated with the ambient temperature.

According to the above description, for example, when frost accumulates on the surface of the evaporator 23 and the temperature on the surface is reduced, notwithstanding the ambient temperature, the ratio of the operating time of the heater 12 relative to the operation stoppage time of the compressor 11 is increased, thereby being able to melt the frost attached to the evaporator 23 more effectively. In this manner, reduction in the cooling efficiency caused by frost on the evaporator can be suppressed and it is facilitated that the temperature in the thermally insulated casing 3 is maintained at a fixed value.

Although the above described second ratio is assumed to be a value of 1, it is not limited thereto, and as long as the ratio is at least greater than the second ratio, a value of lower than it may be set at a value of 1, for example.

<1-2 Abnormality in Sensors>

As illustrated in an embodiment in FIG. 3, when it is determined that there is an abnormality in the sensors (S104: YES), the CFU 101 executes the processing in the above described steps S110, S111, and S112. In an embodiment of the present embodiment, the ratio of the operating time of the heater 12 relative to the operation stoppage time of the compressor 11 when there is an abnormality in the sensors is set at a fixed value irrespective of the ambient temperature. In particular, the fixed ratio in an embodiment of the present embodiment is assumed to be set at a value of 1 which is equal to the first ratio associated with the above described ambient temperature. Thus, the processing after step S104: YES is equivalent to the processing in the steps S110, S111, and S112 where power is continuously supplied to the heater 12 during the operation stoppage time of the compressor 11.

According to the above embodiment, the ratio of the operating time of the heater 12 relative to the operation stoppage time of the compressor 11 may be a fixed ratio when there is an abnormality in the sensors. In this manner, for example, if it is not possible to detect that the ambient temperature is lower than the predetermined temperature, irrespective of the ambient temperature, the ratio of the operating time of the heater 12 relative to the operation stoppage time of the compressor 11 is maintained at a fixed value, thereby being able to reduce a risk of freezing an item to be cooled. Further, for example, if it is not possible to detect that the temperature of the evaporator 23 is lower than the predetermined temperature, irrespective of the ambient temperature, the ratio of the operating time of the heater 12 relative to the operation stoppage time of the compressor 11 is maintained at a fixed value, thereby being able to suppress reduction in the cooling capacity caused by frost on the evaporator 23.

Although the above described "fixed ratio" has a value of 1, it is not limited thereto, and it may be set at a value of smaller than 1.

2. When Thermally Insulating Door Opened or Closed

As illustrated in an embodiment in FIG. 3, when it is determined that the thermally insulating door 4 has been opened/closed (S100: YES), the CPU 101 starts to measure the time period after resetting of the second timer 103*b* (S113), and it is determined whether or not the time t measured by the second timer 103*b* has reached a predetermined time (predetermined period) (S114). In an embodiment of the present invention, as will be described later, when the opening of the thermally insulated casing 3 is opened firstly and then closed by the thermally insulating door 4, the operation of the heater 12 until a predetermined time has elapsed is controlled using the ratio of the operating time of the heater 12 relative to the operation stoppage time of the compressor 11 which is the predetermined ratio (first ratio). After the predetermined time has elapsed, the operation of the heater 12 is controlled using the ratio of the operating time of the heater 12 relative to the operation stoppage time of the compressor 11 which is a predetermined ratio smaller than the first ratio (second ratio). In particular, in an embodiment of the present invention, the first ratio is set at a value of 1 which is equal to the first ratio associated with the above described ambient temperature, and the second ratio is set at a value equal to the second ratio associated with the above described ambient temperature.

The predetermined time instep S114 is preset at a time period that is sufficient to melt the frost attached to the surface of the evaporator 23, for example, and is stored in the memory 102.

When it is determined that the time t measured by the second timer 103*b* has not reached the predetermined time (S114: NO), the CPU 101 executes the following processing.

Firstly, the CPU 101 drives the relay 111 to start the operation of the compressor 11 (S115), and determines whether or not the temperature detected by the thermally insulating casing internal temperature sensor 13 has reached the predetermined minimum allowable temperature in the thermally insulating casing 3 (S116). When it is determined that the temperature inside the thermally insulating casing 3 has not reached the predetermined minimum allowable temperature (S116: NO), the CPU 101 executes the processing in step S116 again. When it is determined that the temperature in the thermally insulating casing 3 has reached the predetermined minimum allowable temperature (S116: YES), the CPU 101 drives the relay 111 to stop the operation of the compressor 11 (S117).

Then, the CPU 101 drives the relay 112 to start supplying the power to the heater 12 (S118), and determines whether or not the temperature detected by the thermally insulating casing internal temperature sensor 13 has reached the predetermined maximum allowable temperature in the thermally insulating casing 3 (S119). When it is determined that the temperature inside the thermally insulating casing 3 has not reached the predetermined maximum allowable temperature (S119: NO), the CPU 101 executes the processing in step S119 again. When it is determined that the temperature in the thermally insulating casing 3 has reached the predetermined maximum allowable temperature (S119: YES), the CPU 101 drives the relay 112 to stop supplying the power to the heater 12 (S120). As described above, the operation of the heater 12 is controlled using the first ratio that is equal to 1.

The CPU 101 executes again the processing in step S114 (the determination of whether or not the time t measured by the second timer 103*b* has reached the predetermined time), and when it is determined that the time t has reached the predetermined time (S114: YES), the processing in step S100 is executed again.

According to the above description, as illustrated in an embodiment in FIG. 4, when opening/closing of the thermally insulating door 4 is detected (time t2), the ratio of the operating time of the heater 12 relative to the operation stoppage time of the compressor 11 may be taken as "ta'/ta'" (=1) (first ratio) until the predetermined time has elapsed. Although not illustrated in an embodiment in FIG. 4, after the predetermined time has elapsed, a ratio (second ratio) smaller than the first ratio may be applied. Generally, when the thermally insulating door 4 is opened/closed, moisture in the atmosphere enters the thermally insulated casing 3, and frost is likely to be attached to the surface of the evaporator 23. Thus, as illustrated in an embodiment of the present invention, irrespective of the ambient temperature, the ratio of the operating time of the heater 12 relative to the operation stoppage time of the compressor 11 is increased only during a predetermined time, thereby being able to melt the frost attached to the evaporator 23 more effectively, for example. In this manner, reduction in the cooling capacity caused by frost on the evaporator 23 can be suppressed, and it is facilitated that the temperature in the thermally insulated casing 3 is maintained at a fixed value.

Although the above described first ratio has a value of 1, it is not limited thereto, and as long as the ratio is at least greater than the second ratio, it may be set at a value lower than 1, for example.

<<<Operation Example>>>

Based on the above described processing sequence of the CPU 101, the compressor 11 and the heater 12 perform the operation example which will be described below.

<When Ambient Temperature Lower than Predetermined Temperature (Before Time t1)>

In an embodiment illustrated in FIG. 4, when the temperature inside the thermally insulated casing 3 is the maximum allowable temperature T1, the compressor 11 starts operation, and when the temperature inside the thermally insulated casing 3 reaches the minimum allowable temperature T2, the operation is stopped. During this period, the temperature of the evaporator 23 decreases from the temperature T3 to the temperature T4. Immediately after the operation of the compressor 11 is stopped, the operation of the heater 12 starts. During the period in which the temperature inside the thermally insulated casing 3 increases from the minimum allowable temperature T2 to the maximum allowable temperature T1, the temperature of the evaporator 23 increases from the temperature T4 to 0° C., and then 0° C. is maintained in the period during which the frost on the surface of the evaporator 23 is melting. When the frost has completely melted, the temperature increases from 0° C. to the temperature T3. That is to say, defrosting on the surface of the evaporator 23 is performed by the heater 12. Immediately after the operation of the heater 12 has stopped, the operation of the compressor 11 starts, and continues until when the temperature inside the thermally insulated casing 3 is the minimum allowable temperature T2. In this manner, when the ambient temperature is lower than the predetermined temperature, the operation of the compressor 11 and the operation of the heater 12 are alternated without interruption. That is to say, the ratio of the operation time ta of the heater relative to the operation stoppage time ta of the compressor 11 is 1.

<When Ambient Temperature Higher than or Equal to Predetermined Temperature (After Time t1)>

In an embodiment illustrated in FIG. 4, when the ambient temperature at a time t1 switches from a temperature lower than the predetermined temperature to that higher than or equal to the predetermined temperature, the heater 12 does not operate and stays in a standby state in a predetermined time tb immediately after the operation of the compressor 11 has been stopped, and starts to operate immediately after the predetermined time tb has elapsed. Then when the temperature in the thermally insulated casing 3 reaches the maximum allowable temperature T1, the operation of the heater 12 is stopped.

As a result, the operating time of the heater 12 is the time tc, and the operation stoppage time of the compressor 11 is the time (tb+tc). Furthermore, in accordance with the time change in the temperature of the evaporator 23, during the time period (tb+tc), defrosting of the surface of the evaporator 23 is performed.

In an embodiment illustrated in FIG. 4, the thermally insulating door 4 is opened/closed at time t2. In this case, although the ambient temperature is higher than or equal to the predetermined temperature, the operation of the heater 12 is controlled using the ratio "ta'/ta' (=1) of the ratio of the operating time of the heater 12 relative to the operation stoppage time of the compressor 11 (first ratio), and thereafter, the heater 12 is controlled with the ratio which is the second ratio smaller than the first ratio (this is not illustrated in FIG. 4).

In an embodiment illustrated in FIG. 4, at a time t2, although the thermally insulating door 4 is opened/closed, it is not limited thereto, and the temperature of the evaporator 23 may be lower than the predetermined temperature, or it may be assumed that an abnormality occurs in the sensor, for example.

According to an embodiment of the present invention, a temperature inside a thermally insulated casing of a cooling box can be maintained at a fixed value while energy saving performance is improved.

<Other Embodiments>

The above embodiments of the present invention are simply for facilitating the understanding of the present invention and are not in any way to be construed as limiting the present invention. The present invention may variously be changed or altered without departing from its spirit and encompass equivalents thereof.

In an embodiment described above, although the heating device is a heater 12 configured to execute a heating operation by being applied with the power, it is not limited thereto. In short, any means may be used as long as the heating device is a means capable of be turned ON/OFF at a preferred timing in order to prevent attachment of frost on the surface of the evaporator 23 disposed in the thermally insulated casing 3 or melt frost attached to the surface.

In an embodiment described above, although the relay 112 is driven to control the operation or stopping of operation of the heater 12, it is not limited thereto, and control may be performed using an element such as a thyristor or a triac.

In an embodiment of the present invention, although the thermally insulating door sensor is a thermally insulating door switch 15, it is not limited thereto, that is to say, any means may be used as long as it is a means for detecting the opening/closing of the thermally insulating door 4.

In an embodiment of the present invention, although the evaporator 23 is disposed in a space (cooling chamber) partitioned by the partitioning panel 31 in the thermally insulated casing 3, it is not limited thereto, and the partitioning panel 31 may be omitted.

What is claimed is:

1. A cooling box comprising:

a thermally insulated casing;

a refrigeration device including a compressor, a condenser, a pressure reducing device, and an evaporator connected in a loop by refrigerant piping, the evaporator disposed inside the thermally insulated casing;

a heater disposed inside the thermally insulated casing and being opposed to the evaporator;

a thermally insulating door provided to open or close an opening of the thermally insulated casing;

a thermally insulating door sensor detecting whether the opening of the thermally insulated casing is in either an open or a closed state;

an evaporator temperature sensor configured to detect a temperature of the evaporator;

an internal temperature sensor detecting an internal temperature of the thermally insulated casing, the internal temperature sensor being provided at a location different from a location of the evaporator temperature sensor;

an ambient temperature sensor detecting an external temperature of the thermally insulated casing; and a control device including a timer and configured to control the compressor and the heater based on the internal temperature of the thermally insulated casing detected by the internal temperature sensor such that alternately either the compressor or the heater are operated to make the internal temperature of thermally insulated casing maintain a predetermined temperature, the compressor and the heater not being operated at the same time, wherein the control device controls the heater with the following operations:

a first operation, when a change of the opening by opening or closing the thermally insulating door is not detected by the thermally insulating door sensor, in which an operating time, during which the heater is on, of the every operation of the heater when the external temperature of the thermally insulated casing detected by the ambient temperature sensor is higher than or equal to the predetermined temperature, becomes smaller than the operating time of the every operation of the heater when the external temperature of the thermally insulated casing detected by the ambient temperature sensor is lower than the predetermined temperature, and the compressor is not operated at least during the heater being operated, and a second operation, when the change of the opening by opening or closing the thermally insulating door is detected by the thermally insulating door sensor, in which the operating time of the every operation of the heater until a predetermined period from the detection of the change counted by the timer has elapsed becomes greater than the operating time of the every operation of the heater after the predetermined period has elapsed, and the compressor is not operated at least during the heater being operated.

2. The cooling box according to claim 1, wherein the control device executes the first operation after the predetermined period has elapsed in the second operation.

3. The cooling box according to claim 1, wherein the control device controls the compressor and the heater such that alternately either the compressor or the heater are incessantly driven until the predetermined period has elapsed in the second operation.

4. The cooling box according to claim 1, wherein the control device controls the compressor and the heater such that alternately either the compressor or the heater are incessantly driven when the external temperature of the thermally insulated casing detected by the ambient temperature sensor is lower than the predetermined temperature in the first operation.

5. A cooling box comprising:

a thermally insulated casing;

a refrigeration device including a compressor, a condenser, a pressure reducing device, and an evaporator connected in a loop by refrigerant piping, the evaporator disposed inside the thermally insulated casing;

a heater disposed inside the thermally insulated casing and being opposed to the evaporator;

an evaporator temperature sensor configured to detect a temperature of the evaporator;

an internal temperature sensor detecting an internal temperature of the thermally insulated casing, the internal temperature sensor being provided at a location different from a location of the evaporator temperature sensor;

an ambient temperature sensor detecting an external temperature of the thermally insulated casing; and a control device configured to control the compressor and the heater based on the internal temperature of the thermally insulated casing detected by the internal temperature sensor such that alternately either the compressor or the heater are operated to make the internal temperature of thermally insulated casing maintain a predetermined temperature, the compressor and the heater not being operated at the same time, wherein the control device controls the heater with the following operations:

a first operation, in which an operating time, during which the heater is on, of the every operation of the heater when the external temperature of the thermally insulated casing detected by the ambient temperature sensor is higher than or equal to the predetermined temperature, becomes smaller than the operating time of the every operation of the heater when the external temperature of the thermally insulated casing detected by the ambient temperature sensor is lower than the predetermined temperature, and the compressor is not operated at least during the heater being operated, and a second operation, in which the operating time of the every operation of the heater when the temperature of the evaporator detected by the evaporator temperature sensor is higher than or equal to a predetermined temperature, becomes smaller than the operating time of the every operation of the heater when the temperature of the evaporator detected by the evaporator temperature sensor is lower than the predetermined temperature, and the compressor is not operated at least during the heater being operated.

6. The cooling box according to claim 5, wherein the control device executes the first operation when the temperature of the evaporator detected by the evaporator temperature sensor is higher than or equal to the predetermined temperature in the second operation.

7. The cooling box according to claim 5, wherein the control device controls the compressor and the heater such that alternately either the compressor or the heater are incessantly driven when the temperature of the evaporator detected by the evaporator temperature sensor is lower than the predetermined temperature in the second operation.

8. The cooling box according to claim 5, wherein the control device controls the compressor and the heater such that alternately either the compressor or the heater are incessantly driven when the external temperature of the thermally insulated casing detected by the ambient temperature sensor is lower than the predetermined temperature in the first operation.

9. A cooling box comprising:

a thermally insulated casing;

a refrigeration device including a compressor, a condenser, a pressure reducing device, and an evaporator connected in a loop by refrigerant piping, the evaporator disposed inside the thermally insulated casing;

a heater disposed inside the thermally insulated casing and being opposed to the evaporator;

an evaporator temperature sensor configured to detect a temperature of the evaporator;

an internal temperature sensor detecting an internal temperature of the thermally insulated casing, the internal temperature sensor being provided at a location different from a location of the evaporator temperature sensor;

an ambient temperature sensor detecting an external temperature of the thermally insulated casing;

a detecting device configured to detect an abnormality in the ambient temperature sensor; and a control device configured to control the compressor and the heater based on the internal temperature of the thermally insulated casing detected by the internal temperature sensor such that alternately either the compressor or the heater are operated to make the internal temperature of thermally insulated casing maintain a predetermined temperature, the compressor and the heater not being operated at the same time, wherein the control device controls the heater with the following operations:

a first operation, in which an operating time, during which the heater is on, of the every operation of the heater when the external temperature of the thermally insulated casing detected by the ambient temperature sensor is higher than or equal to the predetermined temperature, becomes smaller than the operating time of the every operation of the heater when the external temperature of the thermally insulated casing detected by the ambient temperature sensor is lower than the predetermined temperature, and the compressor is not operated at least during the heater being operated, and a second operation, in which when the detecting device detects an abnormality in the ambient temperature sensor, the operating time of the every operation of the heater becomes constantly equal to a fixed supply amount, and the compressor is not operated at least during the heater being operated.

10. The cooling box according to claim 1, further comprising:

a partitioning panel that forms a space including the evaporator, wherein the internal temperature sensor is provided in a space different from the space including the evaporator.

11. The cooling box according to claim 5, further comprising:

a partitioning panel that forms a space including the evaporator, wherein the internal temperature sensor is provided in a space different from the space including the evaporator.

12. The cooling box according to claim 9, further comprising:

a partitioning panel that forms a space including the evaporator, wherein the internal temperature sensor is provided in a space different from the space including the evaporator.

13. The cooling box according to claim 1, wherein the heater is on during the compressor being off, and at a time when the heater is turned off, the compressor is turned on.

14. The cooling box according to claim 13, wherein during the first operation, the heater is turned on after a predetermined time when the compressor is turned off.

15. The cooling box according to claim 5, wherein the heater is on during the compressor being off, and at a time when the heater is turned off, the compressor is turned on.

16. The cooling box according to claim 15, wherein during the first operation, the heater is turned on after a predetermined time when the compressor is turned off.

17. The cooling box according to claim 9, wherein the heater is on during the compressor being off, and at a time when the heater is turned off, the compressor is turned on.

18. The cooling box according to claim 17, wherein during the first operation, the heater is turned on after a predetermined time when the compressor is turned off.

* * * * *